US005088625A

United States Patent [19]

Färber et al.

[11] Patent Number: 5,088,625

[45] Date of Patent: Feb. 18, 1992

[54] DRIVE MECHANISM FOR THE MEASURED DISPENSING OF LIQUIDS OUT OF A STORAGE CONTAINER

[75] Inventors: Karlheinz Färber, Giengen; Klaus Erdmann, Mergelstetten; Willi Niess, Halzhausen; Willi Lindenmaier, Herbrechtingen, all of Fed. Rep. of Germany

[73] Assignees: The Coca-Cola Company, Atlanta, Ga.; Bosch-Siemens Hausgerate GmbH, Munich, Fed. Rep. of Germany

[21] Appl. No.: 625,057

[22] Filed: Dec. 10, 1990

[51] Int. Cl.[5] ..... B67D 5/00

[52] U.S. Cl. ..... 222/129.1; 222/135; 222/333

[58] Field of Search ..... 74/53, 54; 192/415, 192/43, 48.92; 222/333, 255, 278, 504, 136, 129.1, 129.3, 129.4, 135

[56] References Cited

U.S. PATENT DOCUMENTS

| | | | |
|---|---|---|---|
| 2,978,143 | 4/1961 | Arnett et al. | 222/129.1 X |
| 3,081,909 | 3/1963 | Hooker | 222/135 X |
| 3,097,764 | 7/1963 | Loeser | 222/135 X |
| 3,200,919 | 8/1965 | Lanigan et al. | 192/43 |
| 3,539,042 | 11/1970 | Sacchini | 192/41 S |
| 3,803,870 | 4/1974 | Conz | 222/135 X |
| 3,851,798 | 12/1974 | Miller | 222/135 |
| 3,999,686 | 12/1976 | Kato | 222/135 X |
| 4,079,861 | 3/1978 | Brown | 222/333 X |
| 4,444,336 | 4/1984 | Nielsen | 222/504 X |
| 4,496,080 | 1/1985 | Farber et al. | 222/129.3 |
| 4,651,862 | 3/1987 | Greenfield, Jr. | 222/129.1 X |
| 4,856,676 | 8/1989 | Emody | 222/333 X |

FOREIGN PATENT DOCUMENTS

| | | | |
|---|---|---|---|
| 234468 | 7/1964 | Austria | 192/41 S |
| 2221178 | 11/1972 | Fed. Rep. of Germany | 222/129.1 |

OTHER PUBLICATIONS

"How Things Work" Published by Edito-Service S. A. Geneva and Illustrated by Roger Jean Segalat, pp. 208-209.

*Primary Examiner*—Michael S. Huppert
*Assistant Examiner*—Anthoula Pomrening
*Attorney, Agent, or Firm*—Birch, Stewart, Kolasch and Birch

[57] ABSTRACT

A drive system for side-by-side piston pumps connected to beverage concentrate containers in a post-mix beverage dispenser system is described. An electric motor rotates a drive shaft in either a forward or reverse direction for the selective actuation of one or the other of the piston pumps. First and second hollow shafts are concentrically disposed around the drive shaft, one hollow shaft being mechanically coupled through a cam and lever arrangement to each of the piston pumps. Freewheeling clutches are provided between the drive shaft and each of the respective hollow shafts such that one hollow shaft is coupled to rotate with the drive shaft in the forward direction of rotation of the drive shaft and the other hollow shaft is coupled to rotate with the drive shaft in the reverse direction of rotation of the drive shaft.

4 Claims, 2 Drawing Sheets

Figure 1:
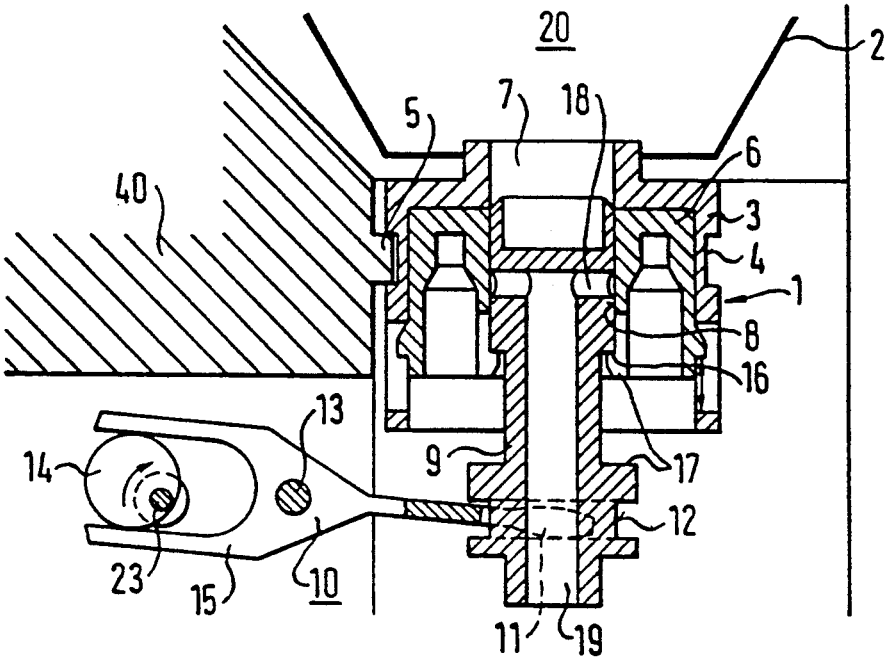

DRIVE MECHANISM FOR THE MEASURED DISPENSING OF LIQUIDS OUT OF A STORAGE CONTAINER

BACKGROUND OF THE INVENTION

The present invention refers to a device for the measured dispensing of liquids from a storage container, particularly for the measured dispensing of beverage concentrates in an automatic beverage dispenser, where drinks can be prepared by mixing a base liquid, e.g. carbonated water, and at least one beverage concentrate stored in a storage tank.

Such a device will preferably be able to provide, in automatic beverage dispensers where carbonated water is mixed with beverage concentrates to make a soft drink, the beverage concentrates in controlled amounts from a storage tank for the mixing process involved in the making of a post-mix beverage. In this connection it is particularly important, while utilizing the simplest possible means when measuring out the carbonated water, to also precisely measure out the dispensed beverage concentrates in order to achieve with necessary precision the desired mix proportions for the postmix drink being prepared. These mix proportions shall achieve the same standard as the comparable ready-made (premix) drinks on the market in bottles or cans.

For placement into automatic beverage dispensers to dispense beverage concentrates, dosage chamber devices have been developed. These dosage chamber devices are attached to a storage tank with the dispensing mouth at the bottom. By means of a magnet system a control valve inside this dosage chamber device is raised from a lower position, where the outlet port of the chamber is closed, to a higher position, where the inlet port of the chamber is closed, so that the contents of the dosage chamber can flow out by force of gravity. However, the dosage chamber space can become filled with air. When the control valve resumes its lower position, the beverage concentrate stored in the storage tank ends up in the dosage chamber by force of gravity, and any air in the dosage chamber will flow into the storage tank. The control force needed to activate the control valve is correspondingly slight, since no actual propulsion force need be produced. There are storage tanks with either rigid or flexible walls. In both cases there is an exchange of volume through extracting beverage concentrates by the use of air.

The above-described dosage chamber devices are very difficult to reduce in size due to technical realities relating to size and the volume they dispense. They are above all suited for dispensing concentrates for 1/10 drink portion units. For smaller amounts greater problems with functioning and dosage precision are presented. So these known dosage chamber dispensers make it difficult to dispense individual drinks on demand.

It is also generally known how to extract and dispense liquid out of a flexible storage tank with the aid of a pump system. In such a system, a storage tank with flexible walls (bag-in-box containers) can be emptied without air having to flow into the storage tank for volume exchange. However, for beverage concentrates to achieve very precise dispensed amounts, these bag-in-box/pump systems have functional limitations.

SUMMARY OF THE INVENTION

An object of the present invention is to make available a mechanism for driving a piston pump system including two piston pumps, where in addition to the efficient, faultless technical operation of the drive system, the piston pump system offers a change for simple separation and interfacing of the respective piston pumps.

A device that corresponds to these requirements is in this invention characterized by the fact that a pivot lever, disposed to pivot about a fixed axis, and drive by a motorized cam drive and located behind an access opening in the device casing, is adapted to be coupled to the piston pump system casing, and has a fork portion for coupling with the drive motor of the piston pump system.

By disposing a drive mechanism of the piston pump at the frontside of the dispenser cabinet interfacing with the piston pump casing and the pivot lever for fixed coupling with the drive motor of the piston pump system, allows that the piston pump system need not be a fixed part of the drive mechanism, but can be a fixed part of a storage tank. This is particularly appropriate and important, because e.g. different beverage concentrates must be mixed with a diluent, e.g. carbonated water, in different specific proportions. By regulated provision of the diluent amounts, these different mix proportions for the beverage concentrate can be achieved through varying dispensing volumes. If the piston pump system is attached directly to the storage tank, the dispensed amounts can immediately be designed to be compatible with the beverage concentrate stored in the tank, according to the dispensing characteristics specified in the piston pump system. Through the close contact of a support yoke in the casing of the dispenser and the piston casing and the fork area of the pivot lever to fixed coupling with the piston system, it is achieved that impulses produced and transferred to the piston pump system are quickly absorbed by the dispenser casing. This helps the operational reliability and accuracy of the total dispensing system, especially if each work cycle is only suitable for slight work lifts. Also handling, particularly when installing the piston pump system, is simplified by these measures. Furthermore, tolerance problems are better controlled.

With automatic beverage dispensers it is desirable to have e.g. two storage tanks of beverage concentrate with their piston pump systems adjacent each other in the apparatus in order to offer the possibility to select one or the other beverage concentrate for mixing with the base liquid or diluent. Correspondingly, also side-by-side, two support yokes in the casing are to be provided for receiving and supporting the piston pump casing, and in their proximity two pivot levers with pickup forks for fixed coupling to the drive motor of the piston pump system. Within the framework of this configuration, it is appropriate to build the system of the present invention so that both cam drives for running the two piston pump systems have a single shared drive motor, with a reversible electric motor driven shaft. Each cam is connected to the driven shaft by a free-wheel coupling whereby both free-wheel couplings are contra-rotating to the drive direction of the shaft. Then it is possible to dispose the two cam drives to revolve on hollow shafts, side-by-side directly on the shaft driven by the reversible electric motor. Preferably the free-wheel couplings for use in the present invention are twisting band clutches or twisting spring clutches to be described hereinafter.

By building the drive mechanism of the invention in this particular way, a simply configured drive system that is accurately controllable can be prepared for the selective delivery of liquids from one of two storage tanks. If these measures are used, the selectivity of the dispensing process can be implemented with electric or electronic controls for the drive motor. Dispensing of liquid through one of the piston pump systems will take place for a desired delivery period purely due to the motor being energized, i.e., if the dispensing cycle is controlled electrically or electronically. The selection of which of the two piston pump systems will dispense liquid from the storage tank depends on the rotation direction of the reversible electric motor, and hence may also be controlled by electrical or electronic signals. Depending on the rotation direction of the reversible electric motor and with the drive shaft, one of the two free-wheel couplings produces the drive connection to its cam drive, while at the same time the drive connection to the other cam drive is disconnected from its free-wheel coupling.

According to another preferred embodiment, the device of the present invention is characterized by the fact that, in addition to a drive cam for driving the electric motor, it is determined which portion of a field applied to the electric motor will control the cam drive so that the cam drive, and with it the associated piston pump system, will return to a definite starting position. In addition, it is also advantageous to arrange on the drive shaft an additional drive cam for controlling a delivery valve for another liquid to be mixed with the liquid being transported through the piston pump system. In automatic beverage dispensers this other liquid is usually carbonated water, or other diluents, stored under pressure in a carbonator. For the delivery of this diluent it is merely necessary to open a valve, so that regulated amounts of this liquid are delivered and can be transported to the mixing area to be mixed with the particular selected beverage concentrate. It is possible to influence this delivery valve purely mechanically by a cam drive but to interface the cam drive with a switch contact that directs the exciting current to one of the electromagnets that activate the delivery valve. These measures to arrange a cam drive for controlling a delivery valve for mixing a diluent with the liquid being transported through the piston pump system make the delivery of this diluent synchronous. Particularly, for the delivery of very small amounts of ready drinks, this synchronizing of the delivery of the diluent is advantageous, since in each work cycle, a definite amount of at times both liquids are produced. An optional multiplication of this delivery cycle hence exerts hardly any influence on the mix relationship.

By arranging two delivery points with a particular cam drive influencing a one-piston pump system, it is advantageous to place the cam drive controlling the electronic motor and/or the cam drive controlling the delivery valve for delivery of the other liquid firmly on the cam drive for the corresponding piston pump system. This will prevent slippage in the area of the free-wheel coupling detrimental to the particular control situation.

Figure 2:
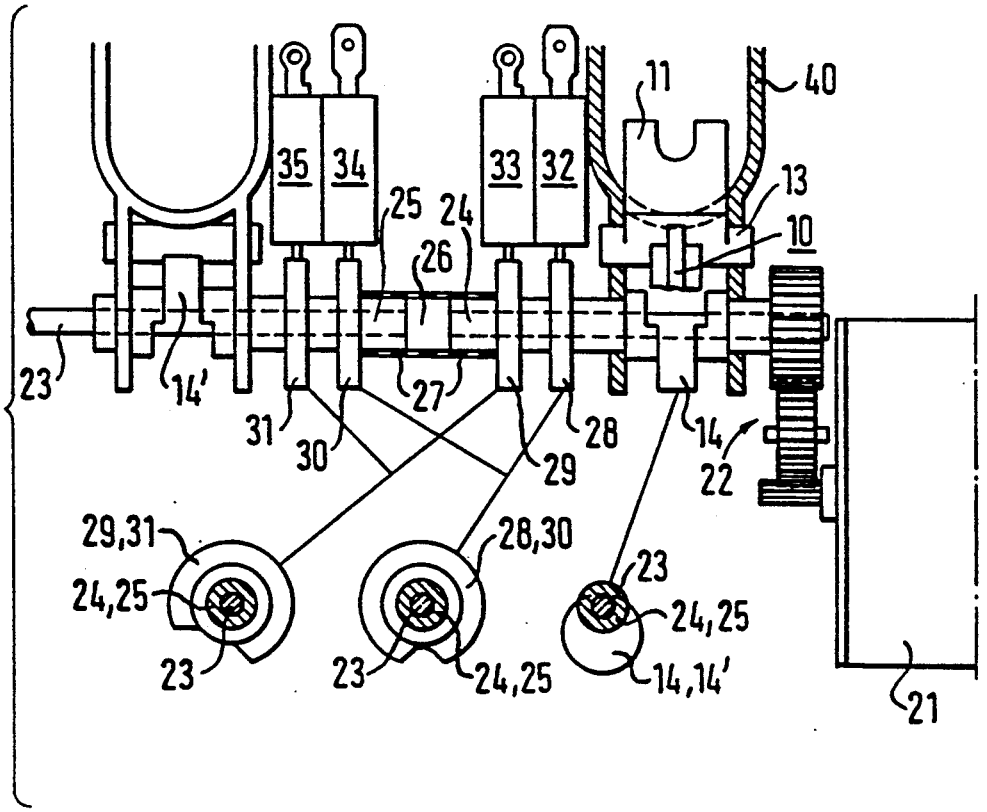
Figure 3:
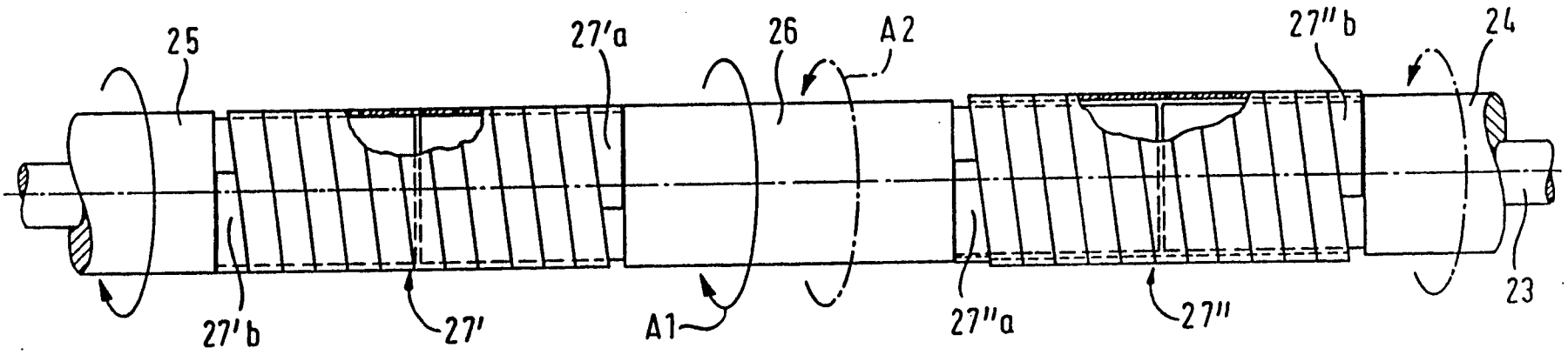

The present invention will become more fully understood from the detailed description given hereinbelow and the accompanying drawings which are given by way of illustration only, and thus, are not limitative of the present invention and wherein:

FIG. 1 is a side cross-sectional view of a simplified representation of a piston pump system with an eccentric drive placed inside a casing of a beverage dispenser; and FIG. 2 is a top view of a simplified representation of an eccentric drive system for two piston pump systems such as that of FIG. 1 placed side-by-side within the casing of a beverage dispenser; and FIG. 3 is an enlarged view of the wrap around band coupling utilized in the eccentric drive system of FIG. 2.

The device of the present invention is part of an automatic beverage dispenser for the delivery of beverage concentrates which, together with carbonated water or other diluents, will be mixed into drinks. In an automatic beverage dispenser beverage concentrates are stored in storage tanks 20, and each is connected to a piston pump system by a joining area 2, through which the desired beverage concentrate is obtainable in the right size doses. This type of system and storage tank is more fully disclosed in prior U.S. application Ser. No. 07/410,882 filed Sept. 22, 1989.

FIG. 1 illustrates the construction of the delivery device. This delivery device is a piston pump system and consists of a pump casing 3, which can be stored and inserted into the delivery area of an automatic beverage dispenser inside its casing or cabinet 40 from the front. For this purpose, the pump casing 3 includes a circular groove 4 into which a yoke-shaped protrusion 5 of the device casing 40 mates. Inside this pump casing 3, is an accelerator (pump) piston 6 axially disposed between impact points so that it can move. These impact points 16, 17 determine the piston lift, which determines the transport volume of the outflowing beverage concentrate every work cycle. An inflow opening 7 in the pump casing 3 which extends to the storage tank 20 and a central bore 8 in the accelerator piston 6 are concentrically arranged, so that inside, the shaft of a control piston 9 can be axially inserted so that it can move. The axial movement between control piston 9 and accelerator piston 6 is again limited by impact points. The control piston 9 is reciprocated by a pivot lever 10 that engages with a fork in one lever end 11 in a groove 12 of the control piston 9. The pivot lever 10 is disposed in the dispenser casing on fixed axis 13 and is driven longitudinally by an eccentric drive cam 14 encircled by a forklike portion of another lever arm 15 of the lever 10.

If the cam 14 moves out of the position illustrated in FIG. 1, the pump piston 6 will be moved down toward impact area 16, so that beverage concentrate from the storage tank 20 is sucked up through the inflow opening 7 into the piston pump system 1. As the cam 14 is further moved, first the upper shaft of the control piston 9 gets into the area of the intake opening 7 and closes it off. As the control piston 9 continues to move up, the impact areas 17 between control piston 9 and accelerator piston 6 engage, so that accelerator piston 6 is now moved up with the control piston 9. Thereby the originally sucked up beverage concentrate amount will be transported over side channels 18 in control piston 9 to a central delivery channel 19 inside control piston 9. From this central delivery channel 19, the beverage concentrate discharges into an area where it will be mixed into a drink with carbonated water also delivered there. It is possible to have as many work cycles as one wishes to follow immediately upon each other so that the delivery amount of the individual work cycles as well as the totality of work cycles can be very precisely determined or arranged. It should be understood that the structure and operation of the piston pump of FIG. 1 is also fully disclosed in the aforementioned application Ser. No. 07/410,882.

FIG. 2 shows in a simpler and more schematic view a drive for two side-by-side piston pump systems 1, according to FIG. 1. An electric motor 21, indeed a reversible electric motor, is placed over a cog wheel drive 22 with a drive shaft 23 connected to the drive. Through appropriate electrical wiring, the electric motor 21 can rotate in both directions and hence also drive the drive shaft 23 in both directions. This drive shaft 23 selectively drives one of two hollow shafts 24 and 25 through which it passes. Hollow shafts 24, 25 are disposed so they can turn in the device casing 40 and carry a cam 14 or 14'', respectively. The shaft 23 carries on a flange area 26 thereof a twisting spring band (wrap around) 27, which selectively engages either hollow shaft 24 or 25 for opposite directions of rotation of shaft 23.

The wrap-around band coupling 27 with the flange area 26 and the hollow shafts 24 resp. 25 are shown more detailed in FIG. 3 in which both partial sections 27' and 27'' of the wrap-around band coupling 27 for a better understanding are separated—in contrast to the assembly shown in FIG. 2. This is advantageous if the drive motor 21 is arranged directly in the flange area 26 between the hollow shafts 24 and 25.

The operation is as follows:

In neutral position the end areas **27'*a* and 27'*b*, 27'*a* and 27''*b* of the partial sections 27' and 27'' of the wrap-around band coupling 27 are in a weak frictional connection with the corresponding parts of the flange area 26, and the hollow shafts 24 and 25. If the flange area 26 is turning in direction of the arrow A1 the end area 27'*a* and the end area 27'*a* are influenced in this direction by which the partial section 27' is contracted because, of its direction of winding and by which the partial section 27' is tightened against the flange area 26 and the hollow shaft 25 while the partial section 27'' also because of its direction of winding is extended and of the end areas 27'*a* and 27''*b* are nearly totally lifted off of the flange area 26 and the hollow shaft 24. In this position the wrap-around band coupling 27 allows a transmission of the driving power from the flange area 26 to the hollow shaft 25, while the frictional force between the end areas 27'*a* and 27''*b* is not sufficient to transmit a driving motion from the flange area 26 to the hollow shaft 24**.

If the flange area 26 is turning in an opposite direction thus in direction of the arrow A2 the partial section 27' extends and the partial section 27'' contracts. Now the driving motion will be transmitted to the hollow shaft 24. It is to be understood that the end areas **27'*a* and 27'*a* of the partial sections 27' and 27'' could be directly connected so that only one wrap-around band coupling 27 exists as shown in FIG. 2**.

Onto hollow shaft 24, as onto hollow shaft 25, two control cams 28,29 and 30,31 respectively have been fastened. These control cams actuate switches 32,33 and 34,35. The control cams 28 and 30 actuate switches 32 and 34 in circuit with the reversible electric motor 21, so that after a particular work phase, it rotates a distance such that the particular hollow shaft 24 or 25 being driven by its cam 14 or 14' is returned to a definite rest position. Hence this ensures that a particular piston pump system 1 completes full work cycles. The control cams 29 and 31 actuate switches 33 and 35 arranged in an electromagnetic system (not shown) that activates a delivery valve for the carbonated water to be mixed with the beverage concentrates. In automatic beverage dispensers this carbonated water is stored under high pressure and usually cooled in a carbonator. When the delivery valve connected to a pressure regulator is opened, carbonated water is delivered by the excess pressure in the carbonator to the mixing area for mixing with carbonator the particular beverage concentrate. Hence each work cycle will furnish a definite amount of beverage concentrate determined by piston pump system 1 and a quantified amount of carbonated water.

The free-wheeling clutches for selectively coupling shafts 24 or 25 to drive shaft 23 in response to the direction of rotation of shaft 23 may take any suitable form known in the art. For example, the operation and structure of a grip-roller free-wheeling clutch as described on page 208 and illustrated in FIG. 2 on page 209 of the publication "How Things Work" published by Edito-Service S. A. Geneva and illustrated by Roger Jean Segalat may be utilized.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An apparatus for dispensing metered quantities of beverage concentrate for mixing with a diluent to produce a post-mix beverage comprising:

at least two storage tanks for containing the beverage concentrate, each said storage tank having a discharge opening through which the concentrate may flow by gravity;

a positive displacement pump means integrally connected with each said storage tank at the discharge opening thereof for withdrawing concentrate through the discharge opening from the storage tank by suction into a housing of the pump means, and discharging metered quantities of concentrate from said pump housing through an outlet thereof for mixing with the diluent in response to mechanical movement of an actuator of said pump means;

a cabinet for housing said at least two storage tanks in a spaced side-by-side relationship for operative association with a supply of diluent, said cabinet including a coupling member therein for engaging the pump housing and rigidly supporting the storage tanks; and drive means in said cabinet for engaging the actuator of the pump means of each storage tank while the storage tank is rigidly supported and imparting said mechanical movement thereto to thereby dispense concentrate from the outlet of the pump housing, said drive means including, a reversible electric motor, a main drive shaft selectively rotatable by said electric motor in a forward or reverse direction, and coupling means for selectively connecting said drive shaft to the actuator of one of the pump means when said electric motor runs in a forward direction, and coupling the other of said pump means to the drive shaft when the electric motor runs in the reverse direction.

2. The apparatus of claim 1 wherein said coupling means comprises:

a drive cam connected to the actuator of each of said pump means; and free-wheel clutch means for selectively connecting the drive shaft to one of said drive cams, in response to the direction of rotation of the drive shaft.

3. The apparatus of claim 2 wherein each drive cam is mounted on a separate hollow shaft, the hollow shaft being disposed end-to-end and concentrically around said drive shaft, said hollow shafts normally being free to rotate about said drive shaft, said free-wheel clutch means selectively coupling one or the other of the hollow shafts to the drive shaft for rotation therewith in response to the direction of rotation of the drive shaft.

4. The apparatus of claim 3 wherein said coupling means further comprises a lever associated with each of said pump means and rotatable about a fixed axis within said cabinet, one end of said lever being engageable by one of said drive cams and the other end of said lever being engageable with the actuator of an associated pump means.

* * * * *